US011371288B2

(12) United States Patent
D'Silva et al.

(10) Patent No.: US 11,371,288 B2
(45) Date of Patent: Jun. 28, 2022

(54) ROTARY STEERABLE DRILLING PUSH-THE-POINT-THE-BIT

(71) Applicant: Halliburton Energy Services, Inc., Houston, TX (US)

(72) Inventors: Alben D'Silva, Edmonton (CA); Everett P. Hagar, Devon (CA); Geoff A. Samuel, Edmonton (CA); Fraser A. Wheeler, Edmonton (CA); Bryan J. Restau, Beaumont (CA); Brandon Jullion, Beaumont (CA)

(73) Assignee: Halliburton Energy Services, Inc., Houston, TX (US)

( * ) Notice: Subject to any disclaimer, the term of this patent is extended or adjusted under 35 U.S.C. 154(b) by 192 days.

(21) Appl. No.: 16/489,771

(22) PCT Filed: May 18, 2017

(86) PCT No.: PCT/US2017/033414
§ 371 (c)(1),
(2) Date: Aug. 29, 2019

(87) PCT Pub. No.: WO2018/212776
PCT Pub. Date: Nov. 22, 2018

(65) Prior Publication Data

US 2021/0285290 A1 Sep. 16, 2021

(51) Int. Cl.
*E21B 7/06* (2006.01)
*E21B 17/10* (2006.01)

(52) U.S. Cl.
CPC ..... *E21B 7/06* (2013.01); *E21B 17/1078* (2013.01)

(58) Field of Classification Search
CPC ..... E21B 17/1078; E21B 7/04; E21B 7/06
See application file for complete search history.

(56) References Cited

U.S. PATENT DOCUMENTS

| | | | | |
|---|---|---|---|---|
| 5,875,859 | A * | 3/1999 | Ikeda | E21B 7/067 175/73 |
| 6,109,372 | A | 8/2000 | Dorel et al. | |
| 7,188,685 | B2 | 3/2007 | Downton et al. | |
| 7,810,585 | B2 | 10/2010 | Downton | |
| 8,011,452 | B2 | 9/2011 | Downton | |
| 8,191,652 | B2 | 6/2012 | Kotsonis et al. | |
| 8,763,725 | B2 | 7/2014 | Downton | |
| 9,057,223 | B2 | 6/2015 | Perrin et al. | |
| 2008/0083567 | A1 | 4/2008 | Downton et al. | |

(Continued)

OTHER PUBLICATIONS

International Search Report and The Written Opinion of the International Search Authority, or the Declaration, dated Dec. 18, 2017, PCT/US2017/03 3414, 15 pages, ISA/KR.

*Primary Examiner* — Dany E Akakpo
(74) *Attorney, Agent, or Firm* — Haynes and Boone, LLP

(57) ABSTRACT

A hybrid Rotary Steerable System (RSS) includes both exterior steering pads as in a push-the-bit system and, internal shaft pistons as in a point-the-bit system. The steering pads and the shaft pistons may cooperate to permit the RSS to achieve tighter turning radii. The steering pads and the shaft pistons may be independently or collectively controllable by diverting a portion of drilling fluid flowing through the RSS. In some embodiments, the steering pads and shaft pistons may extend in opposite directions to steer the drill bit, and on other embodiments, the steering pads and shaft pistons may extend in the same direction.

20 Claims, 6 Drawing Sheets

(56) References Cited

U.S. PATENT DOCUMENTS

| | | | | |
|---|---|---|---|---|
| 2009/0166089 | A1 | 7/2009 | Millet | |
| 2011/0120775 | A1* | 5/2011 | Krueger | E21B 7/067 175/73 |
| 2012/0145458 | A1 | 6/2012 | Downton | |
| 2012/0160565 | A1* | 6/2012 | Downton | E21B 7/062 175/61 |
| 2014/0209389 | A1 | 7/2014 | Sugiura et al. | |
| 2015/0008045 | A1 | 1/2015 | Downton | |
| 2015/0252630 | A1* | 9/2015 | Moyer | E21B 7/06 166/301 |
| 2017/0275948 | A1 | 9/2017 | Bryson | |

* cited by examiner

ROTARY STEERABLE DRILLING PUSH-THE-POINT-THE-BIT

CROSS REFERENCE TO RELATED APPLICATION(S)

The present application is a U.S. National Stage patent application of International Patent Application No. PCT/US2017/033414, filed on May 18, 2017, the disclosure of which is hereby incorporated by reference in its entirety.

BACKGROUND

The present disclosure relates generally to rotary steerable systems (RSS), e.g., drilling systems employed for directionally drilling wellbores in oil and gas exploration and production. More particularly, embodiments of the disclosure relate to a hybrid rotary steerable system having characteristics of both push the bit and point the bit systems.

Directional drilling operations involve controlling the direction of a wellbore as it is being drilled. Usually the goal of directional drilling is to reach a target subterranean destination with a drill string, and often the drill string will need to be turned through a tight radius to reach the target destination. Generally, an RSS changes direction either by pushing against one side of a wellbore wall with steering pads to thereby cause the drill bit to push on the opposite side (in a push-the-bit system), or by bending a main shaft running through a non-rotating housing to point the drill bit in a particular direction with respect to the rest of the tool (in a point-the-bit system). In a push-the-bit system, the wellbore wall is generally in contact with the drill bit, the steering pads and a stabilizer. The steering capability of such a system is predominantly defined by a curve that can be fitted through each of the drill bit, steering pads and the stabilizer.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes a hybrid RSS system having both exterior steering pads as in push-the-bit system and, internal shaft pistons as in a point-the-bit system. The steering pads and the shaft pistons cooperate to permit the RSS to achieve tighter turning radii. The steering pads and the shaft pistons may be independently or collectively controllable by diverting a portion of drilling fluid flowing through the RSS. In some embodiments, the steering pads and shaft pistons may extend in opposite directions to steer the drill bit, and on other embodiments, the steering pads and shaft pistons may extend in the same direction.

Figure 1:
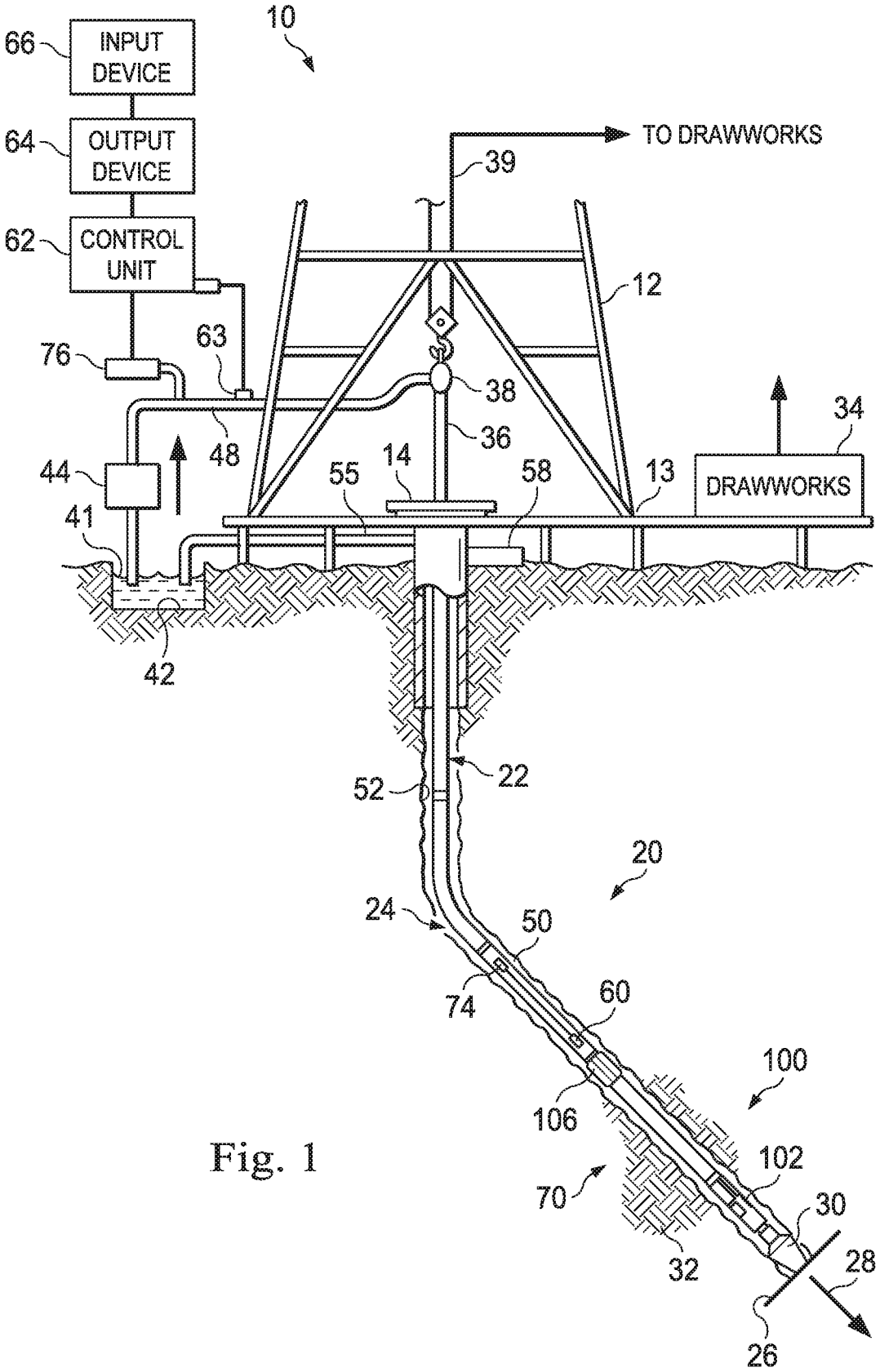
FIG. 1 is a partial cross-sectional side view of a directional drilling system including an RSS according to example embodiments of the disclosure.

FIG. 1 is a partial cross-sectional side view of directional drilling system 10 including an RSS 100. The directional drilling system 10 is illustrated including a tower or "derrick" 12 that is buttressed by a derrick floor 13. The derrick floor 13 supports a rotary table 14 that is driven at a desired rotational speed, for example, via a chain drive system through operation of a prime mover (not shown). The rotary table 14, in turn, is operable to provide rotational force to a drill string 20. The drill string 20, which includes a drill pipe section 22, extends downwardly from the rotary table 14 into a directional borehole 24. The borehole 24 may exhibit a multi-dimensional path or "trajectory." The three-dimensional direction of the bottom 26 of the borehole 24 of FIG. 1 is represented by arrow 28.

A drill bit 30 is attached to the distal, downhole end of the drill string 20. When rotated, e.g., via the rotary table 14, the drill bit 30 operates to break up and generally disintegrate the geological formation 32. The drill string 20 is coupled to a "drawworks" hoisting apparatus 34, for example, via a kelly joint 36, swivel 38, and line 39 through a pulley system (not shown). During a drilling operation, the drawworks 34 can be operated, in some embodiments, to control the weight on drill bit 30 and the rate of penetration of the drill string 20 into the borehole 24.

During drilling operations, a suitable drilling fluid 41 or "mud" can be circulated, under pressure, out from a mud pit 42 and into the borehole 24 through the drill string 20 by a hydraulic "mud pump" 44. Drilling fluid 41 passes from the mud pump 44 into the drill string 20 via a fluid conduit (commonly referred to as a "mud line") 48 and the kelly joint 36. The mud 31 is discharged at the borehole bottom 26 through an opening or nozzle in the drill bit 30, and circulates in an "uphole" direction towards the surface through an annular space 50 between the drill string 20 and the side 52 of the borehole 24. As the drilling fluid 41 approaches the rotary table 14, it is discharged via a return line 55 into the mud pit 42. A variety of surface sensors 58, which are appropriately deployed on the surface of the borehole 24, operate alone or in conjunction with downhole sensors 60 deployed within the borehole 24, to provide information about various drilling-related parameters, such as fluid flow rate, weight on bit, hook load, etc.

A surface control unit 62 may receive signals from surface sensors 58 and downhole sensors, 60 and other devices via a sensor or transducer 63, which can be placed on the mud line 48. The surface control unit 62 can be operable to process such signals according to programmed instructions provided to surface control unit 62. Surface control unit 62 may present to an operator desired drilling parameters and other information via one or more output devices 64, such as a display, a computer monitor, speakers, lights, etc., which may be used by the operator to control the drilling operations. Surface control unit 62 may contain a computer, memory for storing data, a data recorder, and other known and hereinafter developed peripherals. Surface control unit 62 may also include models and may process data according to programmed instructions, and respond to user commands entered through a suitable input device 66, which may be in the nature of a keyboard, touchscreen, microphone, mouse, joystick, etc.

In some embodiments of the present disclosure, the rotatable drill bit 30 is attached at a distal end of a bottom hole assembly (BHA) 70 including the rotary steerable system (RSS) 100. The RSS 100 may be a hybrid system having both exterior steering pads 102 and internal shaft pistons 104 (FIG. 3) for steering the drill bit 30 through the formation 32, and thereby defining the trajectory of the borehole 24. The steering pads 102 may be extendable in a lateral direction from a longitudinal axis of the RSS 100 to push against the geologic formation 32. The extent to which each of a plurality of radially spaced steering pads 102 are extended may be adjustable to assist in controlling the direction of the borehole 24. The RSS 100 may include a stabilizer 106 at a proximal or uphole end thereof. The BHA 70 and/or RSS 100 can provide some or all of the requisite force for the bit 30 to break through the geologic formation 32, e.g., "weight on bit" and torque for turning the drill bit 30, and provide the necessary directional control for drilling the borehole 24.

The BHA 70 and or/the RSS 100 may comprise a Measurement While Drilling (MWD) System and/or a Logging While Drilling (LWD) System, with various sensors to provide information about the formation 32 and downhole drilling parameters. The MWD and or LWD sensors in the BHA 70 may include, but are not limited to, a device for measuring the formation resistivity near the drill bit, a gamma ray device for measuring the devices for determining the inclination and azimuth of the drill string, and pressure sensors for measuring drilling fluid pressure downhole. The MWD System may also include additional/alternative sensing devices for measuring shock, vibration, torque, telemetry, etc. The above-noted devices may transmit data to a downhole communicator 74, which in turn transmits the data uphole to the surface control unit 62.

The transducer 63 can be placed in the mud line 48 to detect the mud pulses responsive to the data transmitted by the downhole communicator 74. The transducer 63 in turn generates electrical signals, for example, in response to the mud pressure variations and transmits such signals to the surface control unit 62. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. A surface transmitter/receiver 76 communicates with downhole tools using, for example, any of the transmission techniques described, such as a mud pulse telemetry technique. This can enable two-way communication between the surface control unit 62 and the downhole communicator 74 and other downhole tools.

Figure 2:
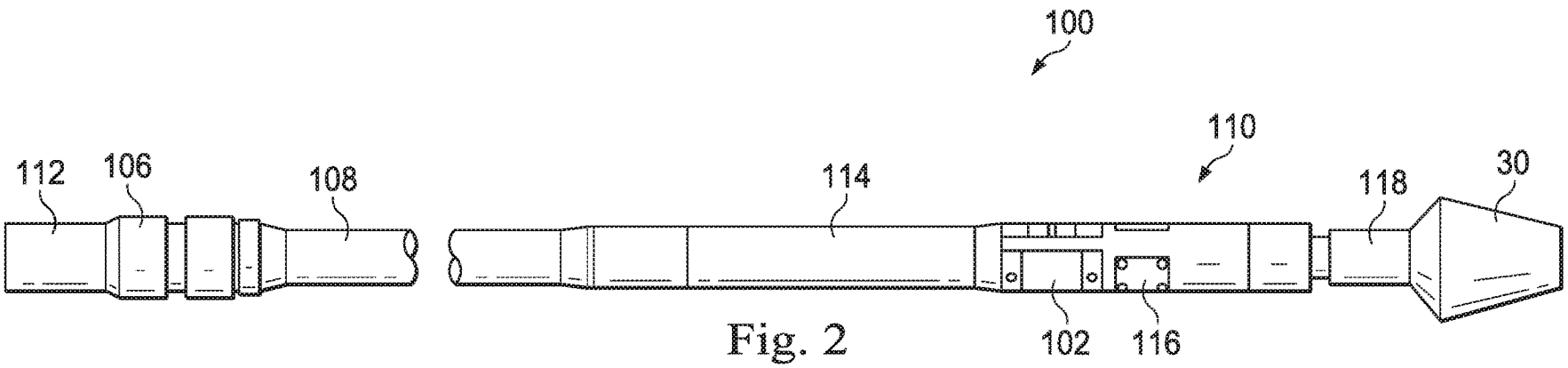
FIG. 2 is a side view of the RSS of FIG. 1 illustrating a stabilizer, flexible collar and a steering head or the RSS.

FIG. 2 is a side view of the RSS 100 illustrating the stabilizer 106, a flexible collar 108 and a steering head 110. The stabilizer 106 may include a structural connector 112, threads, latches, etc. at trailing or uphole end thereof for selectively coupling to an MWD system, drill pipe section 22 (FIG. 1) or other conveyance for carrying the RSS downhole. The stabilizer 106 protrudes radially from the structural connector 112, and in some embodiments, the stabilizer 106 may include one or more radially spaced blades that permit the drilling fluid 41 (FIG. 1) to flow therebetween. In the illustrated embodiment, the flexible collar 108 is coupled between the stabilizer 106 and the steering head 110. The flexible collar 108 may exhibit a lower bending stiffness than the drill pipe section 22 (FIG. 1), stabilizer 106 and/or a housing 114 of the steering head 110. The steering head 110 includes the exterior steering pads 102, which may be selectively extended to engage a side 52 of the borehole 24 (FIG. 1) and urge the RSS in a direction away from the engaged side 52. The steering head 110 also includes hatch covers 116, which cover internal shaft pistons 104 (FIG. 3) as described in greater detail below. The internal shaft pistons 104 are operable to selectively urge an articulating shaft 118 extending through the housing 110 of the steering head 110 in a lateral direction with respect to the housing 114. The drill bit 30 is supported at the end of the articulating shaft 118 such that the drill bit 30 may be steered in a lateral direction with respect to the housing 114.

The RSS 100 generally provides three points of contact with the borehole 24. Specifically, the drill bit 30, the exterior steering pads 102 and the stabilizer are arranged to engage a side 52 of the borehole in operation. The RSS 100 may be operable to maintain contact with the borehole 24 while rotating. For example, a first one of three radially spaced exterior steering pads 102 may be extended to engage a lower side 52 of the wellbore 24 while the other two exterior steering pads 102 on an upper side of the RSS are retracted. As the RSS 100 is rotated, e.g., by rotary table 14 (FIG. 1), the first exterior steering pad 102 may be retracted while moving to the upper side of the RSS 100, and a second exterior steering pad 100 is extended as it rotates to the lower side of the RSS 100. In this manner, one exterior steering pad 102 is maintained in contact with the lower side 52 urging the drill bit toward the upper side 52 of the borehole 24.

Figure 3:
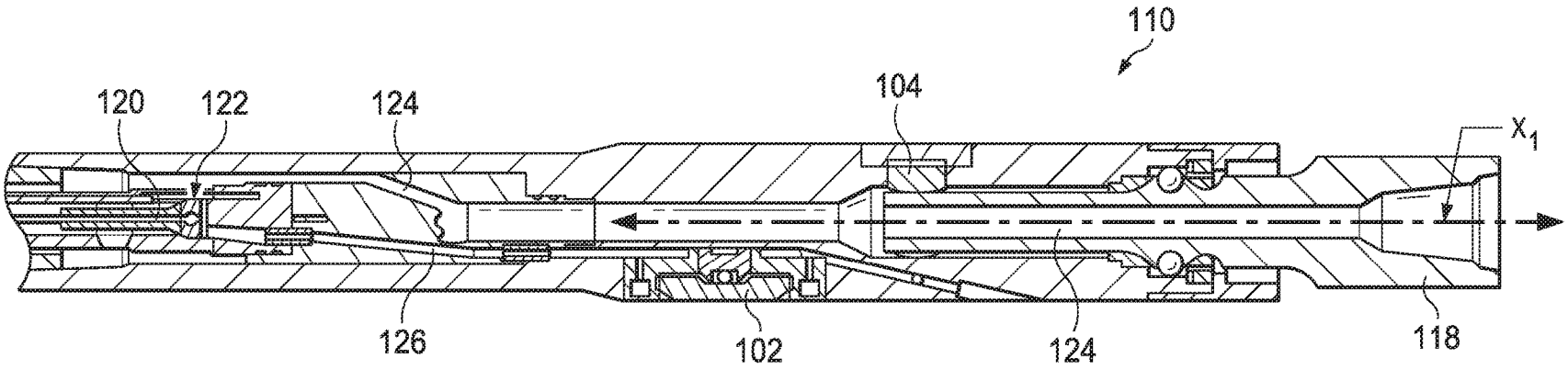
FIG. 3 is a cross-sectional side view of the steering head of FIG. 2 illustrating an articulating shaft in a neutral position for axial drilling.

FIG. 3 is a cross-sectional side view of the steering head 110 illustrating the articulating shaft 118 in a neutral position for straight or axial drilling along a longitudinal axis $X_1$ of the steering head 110. The steering head 110 includes an interior flow channel 120 in fluid communication with the drill pipe section 22 of the drill string 20 (FIG. 1). A valve 122 is provided in the interior flow channel 120 for selectively controlling the distribution of fluid flow between a main bypass flow channel 124 and at least one biasing flow channel 126. In some embodiments the valve 122 may be a rotary disc valve selectively operable to deviate about 5-10% of mudflow from the main bypass flow channel 124 into the one or more biasing flow channel 126. In other embodiments, the valve 122 may include any number of mechanically driven/controlled valve assemblies including barrel valves, gate valves, swash plates, moneau displacement pumps, etc., which may be driven or controlled by traditionally employed solenoids, servo motors, gearboxes and/or bearing assemblies etc.

The main bypass flow channel 124 extends through the articulating shaft 118 and delivers drilling fluid 41 (FIG. 1) to the drill bit 30 (FIG. 1). The at least one biasing flow channel 126 extends to the exterior steering pads 102 and the internal shaft pistons 104. As illustrated in FIG. 3, the exterior steering pads 102 and the internal shaft pistons 104 are disposed in a retracted position with respect to the housing 114. In the retracted position, the exterior steering pads 102 may be generally flush with an exterior surface 130 of the housing 114 such that no directional force is applied to a side 52 of the borehole 24 (FIG. 1). The internal shaft pistons 104 may engage the articulating shaft 118 to generally align the articulating shaft with the longitudinal axis $X_1$ of the steering head 110.

Figure 4:
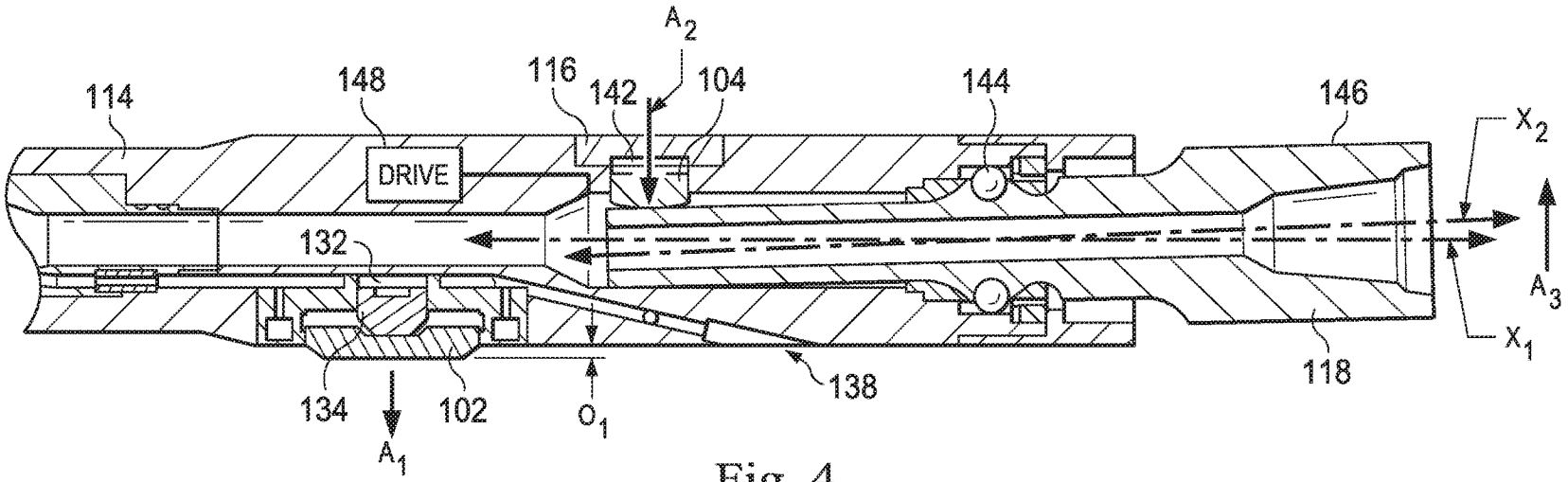
FIG. 4 is a cross-sectional side view of the steering head of FIG. 2 illustrating the articulating shaft biased by a steering pad and shaft piston to an offset position for directional drilling.

FIG. 4 a cross-sectional side view of the steering head 110 illustrating the articulating shaft 118 biased to an offset position for directional drilling. When drilling fluid 41 (FIG. 1) is diverted through a biasing flow channel 126 extending to the external steering pad 104, the drilling fluid pressurizes a chamber 132 to drive a pad piston 134 in a lateral direction as indicated by arrow $A_1$. The movement of the pad piston 134 drives the exterior steering pad 102 to an offset position where the steering pad 102 is offset from the exterior surface 130 by an offset $O_1$. The offset $O_1$ operates to permit the exterior steering pad 102 to engage a side 52 of the bore hole 24, and bias the housing 114 in a direction opposite arrow $A_1$. After passing through the chamber 132, the drilling fluid 41 may exit through discharge port 138 into the annular space 50 (FIG. 1) surrounding the steering head 110.

Similarly, when drilling fluid 41 is diverted to a biasing flow channel 126 (not shown) extending to the internal shaft piston 104, the drilling fluid 41 pressurizes a chamber 142 defined between the internal shaft piston 104 and hatch cover 116. The internal shaft piston 104 is thereby driven in a lateral direction as indicated by arrow $A_2$. The movement of the internal shaft piston 104 causes the articulating shaft 118 to pivot about CV joint 144 such that an axis $X_2$ of the articulating shaft is offset from the axis $X_1$ of the steering head 110. A distal end 146 of the articulating shaft 118 is thereby driven in a steering direction, e.g., the direction of arrow $A_3$ with respect to the housing 114. The distal end 146 of the articulating shaft 118 includes a threaded box connector thereon for coupling the drill bit 30 (FIG. 1). Thus, in this manner, the external steering pads 102 and the internal shaft pistons 104 may be extended together to steer the drill bit 30 generally in the direction of arrow $A_3$. The operation of the valve 122 may be tied to the rotation of the drill string 20 such that the radially spaced external steering pads 102 and/or internal shaft pistons may be selectively extended to maintain the bias on the drill bit 30 in the desired offset direction as the drill string 20 rotates.

In some embodiments, the external steering pads 102 and the internal shaft pistons 104 may be tied together such that a particular external steering pad 102 and internal shaft piston 104 move together between extended and retracted positions. For example, the chambers 132, 142 may be fluidly coupled to one another such that the two chambers 132, 142 may be collectively pressurized to drive the pad piston 134 and shaft piston 104 together in the directions of arrows $A_1$ and $A_2$ together. In other embodiments, the external steering pads 102 and the internal shaft pistons 104 may be independently controllable. Arrangements for collective and independent control of the pad pistons 134 and internal shaft pistons 104 are discussed below, e.g., with reference to FIG. 9. An independently controllable system may be operated through a first portion of a wellbore with either the pad piston 134 or the shaft piston 104 operated independently through a first portion of a wellbore, e.g., where the other of the pad piston 134 and shaft piston 104 is maintained in a retracted position. When a second portion of the wellbore is encountered, e.g., a portion of the wellbore including a kick-off-point or wellbore portion with a relatively high dogleg severity, both the pad piston 134 and shaft piston 104 may be operated together to provide a relatively high steering force.

In some embodiments, the articulating shaft 118 rotates with the housing 114, e.g., the articulating shaft 118 and the housing 114 both rotate about axis $X_1$ when the housing 114 is rotated, e.g., with the rotary table 14 (FIG. 1). The drill bit 30 (FIG. 2) may thus be rotated by rotating the housing 114. In other embodiments, the articulating shaft 118 could optionally be coupled to a rotary drive 148, which may be operable to rotate the articulating shaft 118 with respect to the housing 114, e.g., about the axis $X_2$ of the articulating shaft 118. In some embodiments, the rotary drive may include an electric motor, a motor driven by the passage of drilling fluid 41 therethrough, or another type of rotary drive operable in downhole conditions. Where the articulating shaft 114 rotates with respect to housing, additional and/or alternative equipment (not shown) may be provided to rotationally support the articulating shaft 118 while still permitting the articulating shaft 114 to pivot with respect to the housing 114, e.g., in the direction of arrow $A_3$.

Figure 5:
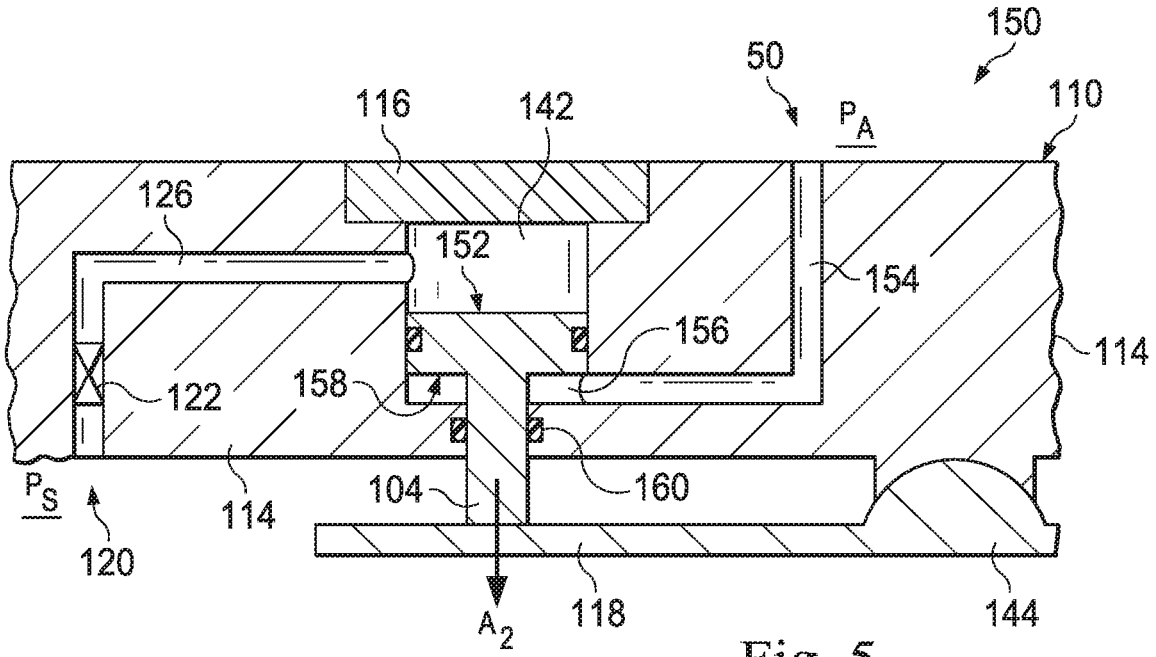
FIG. 5 is a cross-sectional side view of a fluid flow system for controlling the internal shaft piston of FIG. 4.

FIG. 5 is a cross-sectional side view of a fluid flow system 150 for controlling the internal shaft piston 104. A fluid pressure within the drill pipe section 22 of the drill string 20 (FIG. 1) and in the interior flow channel 120 of the steering head 110 (FIG. 3) is represented by a standpipe pressure $P_S$. A fluid pressure of the annular space 50 is represented by an annulus pressure $P_A$. The valve 122 is illustrated in the biasing flow channel 126 extending to the chamber 142 such that the valve 122 may selectively apply the standpipe pressure $P_S$ to a first pressure surface 152 of the shaft piston 104. A vent shaft 154 fluidly couples the annular space 50 to a chamber 156 adjacent a second pressure surface 158 of the internal shaft piston 104. The vent shaft 154 may be substantially open such that the annulus pressure $P_A$ is applied to the second pressure surface 158.

The hatch cover 116 fluidly isolates the annular space 50 from the chamber 142, and the interior flow channel 120 is fluidly isolated from the chamber 156 and the second pressure surface 158 by a seal member 160 defined between the housing 114 and the internal shaft piston 104. Thus, the valve 122 is operable to control a pressure differential between the first and second pressure surfaces 152, 158 of the internal shaft piston 104. Generally, in operation, the standpipe pressure $P_S$ is greater than the annulus pressure $P_A$, and the valve 122 may be opened to apply the greater standpipe pressure $P_S$ to the first pressure surface 152 while the lower annulus pressure $P_A$ is applied to the second pressure surface 158. This pressure differential urges the internal shaft piston 104 in the direction of arrow $A_2$ against a proximal end of the articulating shaft 118 to induce the articulating shaft 118 to pivot about CV joint 144. The seal member 160 accommodates the lateral movement of the internal shaft piston 104 with respect to the housing.

Figure 6:
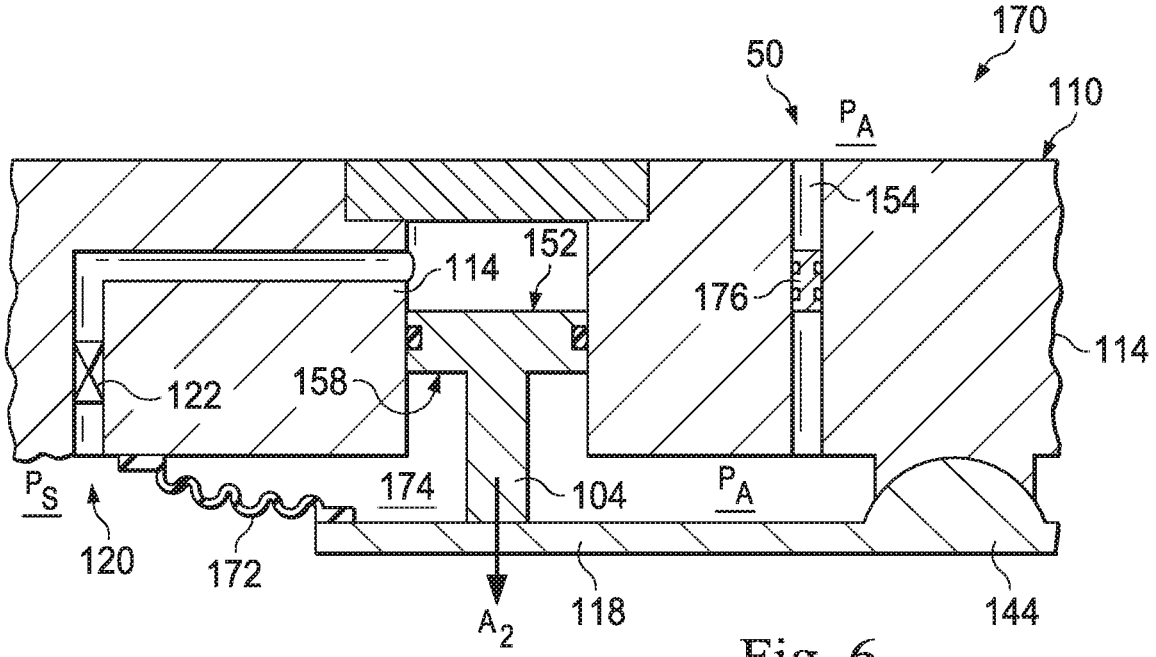
FIG. 6 is a cross sectional side view of an alternate fluid flow system controlling the shaft piston of FIG. 4 including a bellows seal defined between the articulating shaft and an outer housing.

FIG. 6 is a cross sectional side view of an alternate fluid flow system 170 for controlling the internal shaft piston 104. The fluid flow system 170 includes a bellows seal 172 defined between the articulating shaft 118 the housing 114. The bellows seal 172 accommodates the pivotal motion of the articulating shaft 118 with respect to the housing 114 and fluidly isolates a chamber 174 from the interior flow channel 120 of the steering head 110. The chamber 172 may be filled with oil or another fluid, which may be maintained at annulus pressure $P_A$ through the vent shaft 154. A compensator piston 176 may be disposed within the vent shaft 154 to accommodate the redistribution of oil in the chamber 174 due to movement of the articulating shaft 118.

The valve 122 is again operable to control a pressure differential between the first and second pressure surfaces 152, 158 of the internal shaft piston 104. Since the oil in chamber 174 is applied against the second pressure surface 158 at the annulus pressure $P_A$, the valve 122 may be opened to apply the greater standpipe pressure $P_S$ to the first pressure surface 150 thereby urge the internal shaft piston 104 in the direction of arrow $A_2$. The articulating shaft 118 may pivot about CV joint 144 and the bellows seal may expand to accommodate the pivotal motion.

Figure 7:
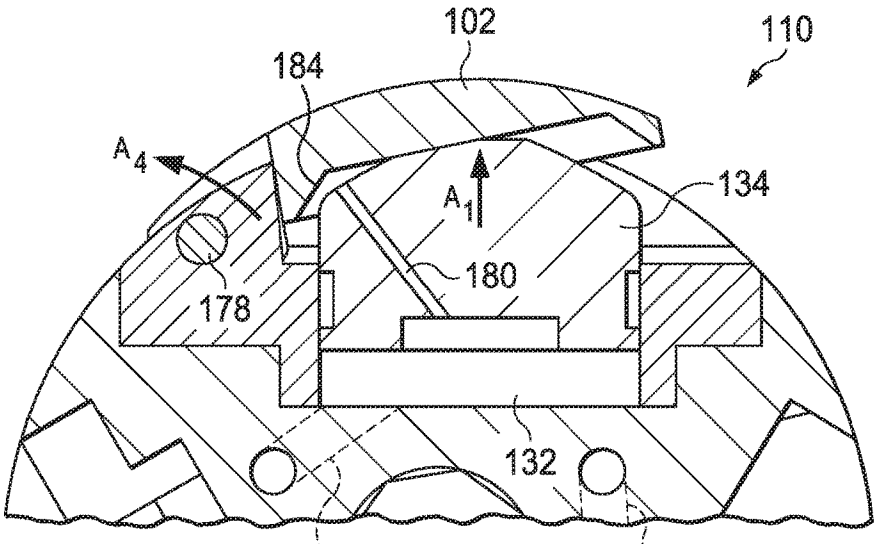
FIG. 7 is a cross-sectional axial view of the external biasing pad of FIG. 4 illustrating a pivoting biasing pad driven by a pad piston with a cleaning port defined therethrough.

FIG. 7 is a cross-sectional axial view of the external biasing pad 102 illustrating the biasing pad 102 coupled to the housing 114 about a pivot pin 178. When the drilling fluid 41 (FIG. 1) is provided to chamber 132 through biasing passageway 126, the pad piston 134 is urged laterally in the direction of arrow $A_1$. The pad piston 134, in turn, urges the external biasing pad 102 to pivot in the direction of arrow $A_4$ about the pivot pin 178, and the external biasing pad 102 may thereby engage a side 50 of borehole 24 (FIG. 1) to urge the steering head 110 in a direction opposite arrow $A_1$.

In some embodiments, the pad piston 134 includes a cleaning port 80 extending therethrough. Drilling fluid 41 may be directed from the chamber 132 to clean the pivot pin 178 to facilitate the pivotal motion of the external biasing pad 102. The extension of the external biasing pads 102 may be limited by a feature such as taper 184. The taper 184 may be arranged to engage the housing 114 or the pad piston 134 when a maximum extension is achieved to prevent over extension. In other embodiments, the external biasing pads 102 may be eliminated, and pad pistons 134 may be arranged to engage the side 50 of the borehole 24 (FIG. 1) directly.

Figure 8:
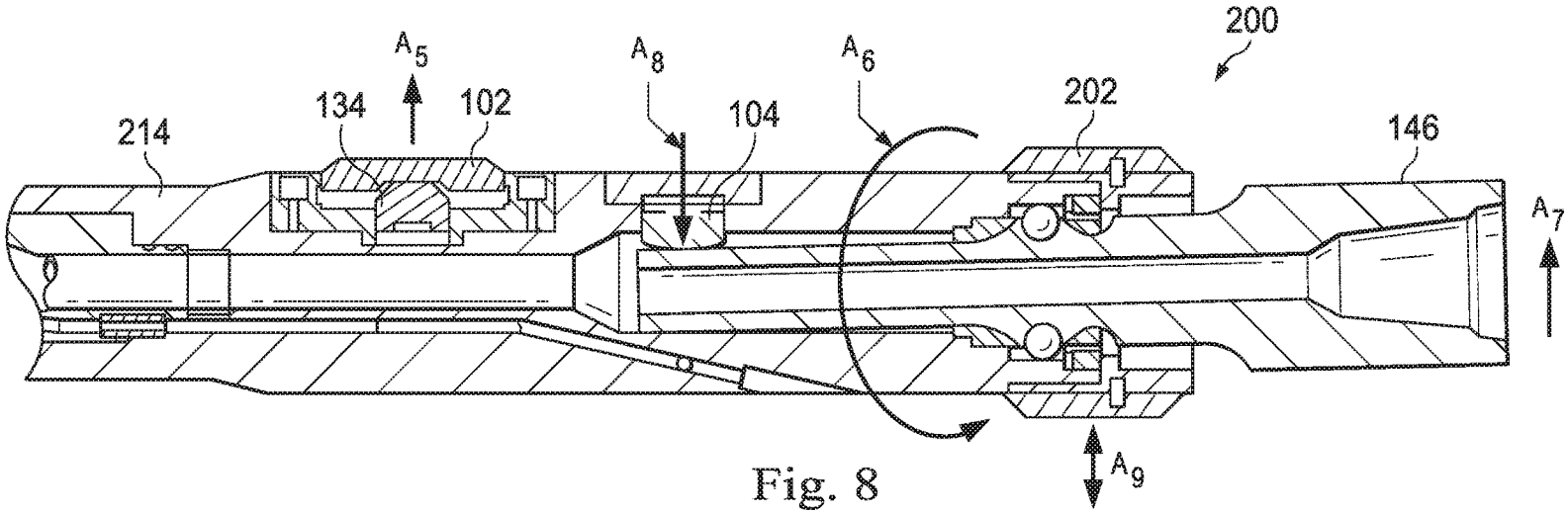
FIG. 8 is a cross-sectional side view of an alternate steering head including a lower stabilizer defined below the steering pads.

FIG. 8 is a cross-sectional side view of an alternate steering head 200 including a lower stabilizer 202 defined below the exterior steering pads 102. The lower stabilizer 202 may engage the side 50 of a borehole 24 (FIG. 1) to act as a fulcrum point about which the steering head 200 may pivot. The exterior steering pads 102 may be moved in the direction of arrow $A_5$ to the extended position illustrated to engage the side of the borehole 24. The steering head is 200 is thereby urged to pivot about the lower stabilizer 202 in the direction of arrow $A_6$, driving the distal end 146 of the articulating shaft 118 and the drill bit 30 (FIG. 2) in the direction of arrow $A_7$. Additional deflection of the drill bit 30 in the direction of arrow $A_7$ may be achieved by pivoting the articulating shaft 118 with respect to housing 214, e.g., by extending internal shaft piston 104 in the direction of arrow $A_8$ as described above. When the lower stabilizer 202 is employed, the external steering pads 102 and the internal shaft pistons 104 may both be disposed on the same lateral side of the steering head 200, e.g., an upper side, and be extended in the opposite directions, e.g., in the directions of arrows $A_5$ and $A_8$ to provide additional deflection to the drill bit 30.

The arrangement of the steering head 200 may be particularly effective when lower stabilizer 202 is sized to be substantially similar to the borehole gauge. In some embodiments, the gauge of lower stabilizer 202 may be adjustable such that the lower stabilizer 202 may be laterally extended when desired and laterally retracted when not in use. For example, the stabilizer 202 may be operably coupled to an actuator 216 such as a hydraulic piston, solenoid or other mechanism for extending and retracting the stabilizer in the direction of arrows $A_9$.

Figure 9:
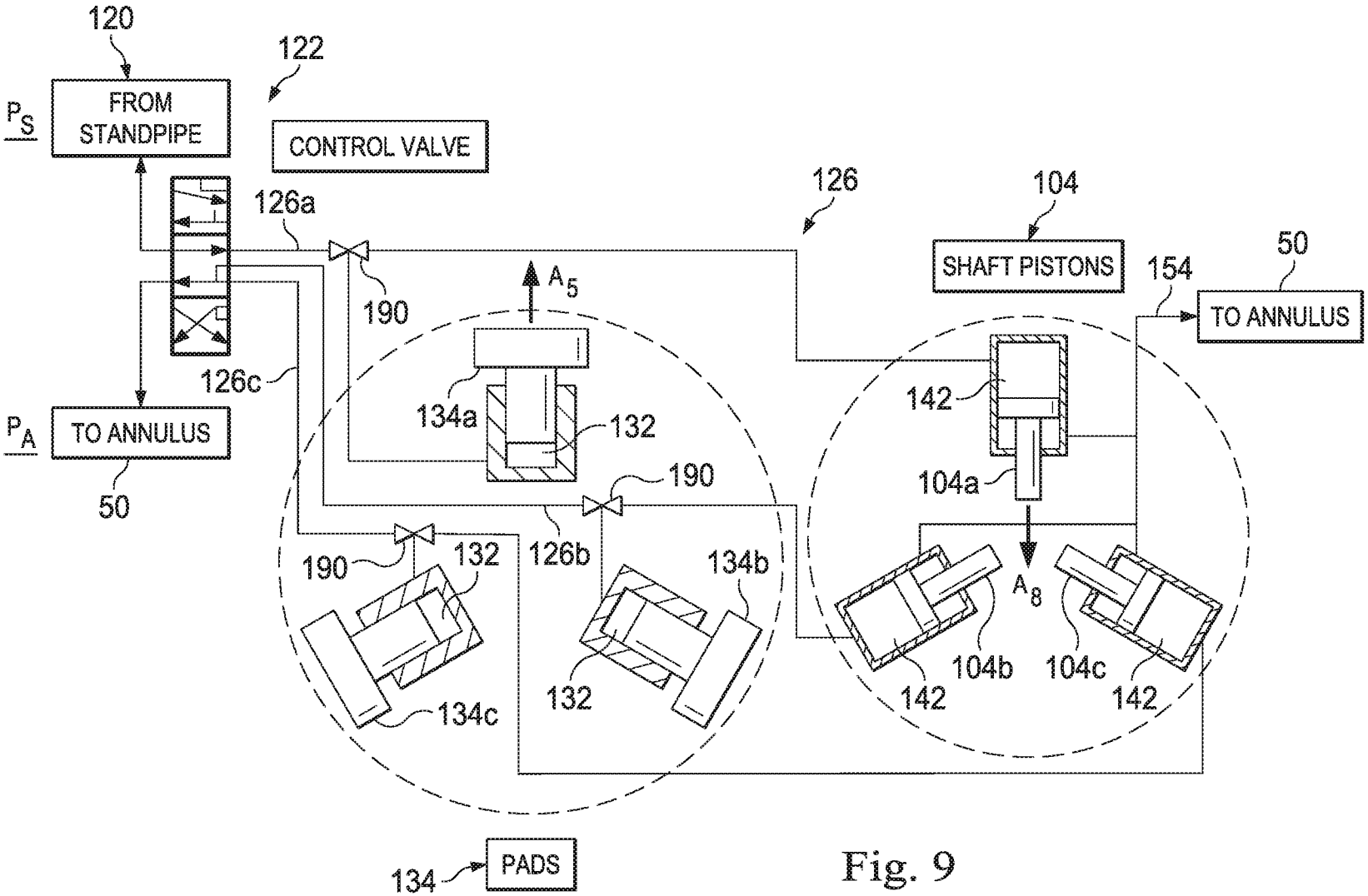
FIG. 9 is a schematic flow diagram illustrating fluid pathways extending to the external steering pads and internal shaft pistons.

FIG. 9 is a schematic flow diagram illustrating biasing fluid pathways 126 extending to the respective chambers 132, 142 associated with each pad pistons 134 and the internal shaft pistons 104. In the illustrated embodiment, three pad pistons 134*a*, 134*b* and 134*c* are radially spaced from one another and correspond respectively to three internal shaft pistons 104*a*, 104*b* and 104*c*. A first pad piston 134*a* is arranged to move in the direction of arrow $A_5$ when pressure is applied thereto, while the corresponding first internal shaft piston 104*a* is arranged to move in the direction of arrow $A_8$ when pressure is applied thereto. The control valve 122 is illustrated as being fluidly coupled to both the interior flow channel for a supply of standpipe pressure $P_S$, and also to the annular space 50 for a source of annulus pressure $P_A$.

The valve 122 is illustrated as being selectable among three positions. When the center position is selected (as illustrated), the standpipe pressure $P_S$ is supplied through a first biasing fluid pathway 126*a* to the first pad piston 134*a* and the corresponding first shaft piston 104*a*. The first pad piston 134*a* and the first internal shaft piston 104*a* are thereby both moved to the extended position. Second and third biasing fluid pathways 126*b* and 126*c* are both coupled to the annulus pressure $P_A$, and consequently, the second and third pad pistons 134*b*, 134*c* and the second and third internal shaft pistons 104*b*, 104*c* are disposed in the retracted positions. This arrangement induces the drill bit 30 (FIG. 1) to assume a particular offset the wellbore 24. When the first pad piston is arranged in an upper orientation in the wellbore, e.g., this arrangement may induce the drill bit 30 to assume a downward offset in the direction of arrow $A_2$.

As the drill string 20 (FIG. 1) is rotated, the position of the valve 122 may re-selected to maintain the offset direction of the drill bit 30 (FIG. 1) in the wellbore 24. For example, when the second pad piston 134 rotates into the upper orientation in the wellbore 24, the upper position of the valve 122 may be selected. When the upper position of the valve 122 is selected, the second biasing fluid pathway 126*b* is coupled to the standpipe pressure $P_S$ and the first and third biasing fluid pathways 126*a*, 126*c* are coupled to the annulus pressure $P_A$. The second pad piston 134*b* and the second internal shaft piston 104*b* are thereby extended, while the first and third pad pistons 134*a*, 134*c* and the first and third internal shaft pistons 104*a*, 104*c* are retracted. In this manner, the downward offset of the drill bit 30 in the wellbore may be maintained. Similarly, the lower position of the valve 122 may be selected to extend the third pad piston 134*c* and the third internal shaft piston 104*c* while the first and second pad pistons 134*a*, 134*b* and the first and second internal shaft pistons 104*a*, 104*b* are retracted.

In some embodiments, supplemental valves 190 may optionally be provided in the first, second and third biasing fluid pathways 126*a*, 126*b* and 126*c* at the branches where the biasing fluid pathways divide between the pad pistons 134 and the internal shaft pistons 104. The supplemental valves 190 may be operable to selectively close at least one of the branches individually. For example, the supplemental valves 190 may operate to close each of the branches extending to the shaft pistons 104. The RSS 100 (FIG. 1) may then operate as a push-the-bit system by extending the pad pistons 134 alone without extending the shaft pistons 104. The RSS 100 may be steered in this manner until additional deviation may be required, e.g., at a kick-off-point where a change in wellbore direction is planned. The supplemental valves 190 may all then be opened to permit the standpipe pressure to be delivered to a pad piston 134 and the corresponding shaft piston 104 together. The RSS 100 may then be steered with both the pad pistons 134 and the shaft pistons 104 through a build section of the wellbore with additional deviation provided to a drill bit 30 (FIG. 1). When the build section is complete, the supplemental valves 190 may again be closed to prevent extension of the shaft pistons 104. In this manner, the wear on the shaft pistons 104 may be reduced.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a rotary steerable system including a housing defining a longitudinal axis and an articulating shaft extending at least partially through the housing. The articulating shaft may be and pivotable between a neutral position generally aligned with the longitudinal axis and an offset position obliquely arranged with respect to the longitudinal axis. A drill bit is supported at a distal end of the articulating shaft, and at least one pad piston extends laterally from the housing toward an exterior side of the housing to thereby urge the housing in an opposite lateral direction and the drill bit in a lateral steering direction. At least one shaft piston is extendable laterally with respect to the housing toward the articulating shaft to thereby pivot the articulating shaft within the housing to further urge the distal end of the articulating shaft in the steering direction.

In one or more example embodiments, the at least one pad piston and the at least one shaft piston are disposed on opposite lateral sides of the housing and extend in the same direction to urge the distal end of the articulating shaft in the steering direction. In other example embodiments, the rotary steerable system further includes a lower stabilizer disposed below the at least one pad piston, and the at least one pad piston and the at least one shaft piston are disposed on the same lateral side of the housing and extend in opposite directions to urge the distal end of the articulating shaft in the steering direction.

In some embodiments, the rotary steerable system further includes a valve operable to direct a portion of drilling fluid from an interior flow channel of the housing to the at least one pad piston and the at least one shaft piston. A biasing flow channel may extend from the valve branches to both the at least one pad piston and the at least one shaft piston such that drilling fluid provided through the biasing flow channel may extend both the both the at least one pad piston and the at least one shaft piston. In some embodiments, the rotary steerable system may further include a supplemental valve in the biasing flow channel operable to prohibit flow to the at least one shaft piston and/or the at least one pad piston.

In some embodiments, the rotary steerable system includes a biasing flow channel that extends from the valve to a first pressure surface of the at least one shaft piston, and a vent shaft that extends from an exterior of the housing to a second pressure surface of the at least one shaft piston such than annulus pressure may be applied to the second pressure surface. In one or more embodiments, the rotary steerable system further includes a seal member for fluidly isolating the second pressure surface from the interior flow channel of the housing. The seal member may include a bellows seal defined between the housing and the articulating shaft, and the bellows seal may be flexible to accommodate articulation of the articulating shaft within the housing.

In some embodiments, the rotary steerable system further includes at least one external steering pad operatively associated with the at least one pad piston. The at least one external steering pad may be pivotally coupled to the housing to pivot outward when the at least one pad piston is extended. In some embodiments, the at least one pad piston may include at least three pad pistons radially spaced about the housing, and the at least one shaft piston may include at least three shaft pistons radially spaced about the housing.

In another aspect, a steerable drilling system includes a drill string extending from a surface location into a borehole. The drill string is operable to rotate about a longitudinal axis of the drill string. A housing is supported within the drill string, and an articulating shaft extends at least partially through the housing. The articulating shaft is pivotable between a neutral position generally aligned with the longitudinal axis and an offset position obliquely arranged with respect to the longitudinal axis. A drill bit is supported at a distal end of the articulating shaft. At least one pad piston is extendable laterally from the housing to engage a side of the borehole and thereby urge the housing in an opposite lateral direction and the drill bit in a lateral steering direction. At least one shaft piston is extendable laterally with respect to the housing toward the articulating shaft to thereby pivot the articulating shaft within the housing to urge the distal end of the articulating shaft and the drill bit in the steering direction.

In one or more example embodiments, the steerable drilling system further includes a flexible collar coupled within the drill string between the housing and a drill pipe section of the drill string. The flexible collar exhibits a lower bending stiffness than the drill pipe section. The steerable drilling system may further include a stabilizer coupled in the drill string between the drill pipe section and the flexible collar. The drilling system may further include a lower stabilizer extending from the housing below the at least one pad piston. The steerable drilling system may further include an actuator operably coupled to the lower stabilizer, and the actuator may be selectively operable to retract the lower stabilizer laterally with respect to the housing. In one or more embodiments, the at least one pad piston and the at least one shaft piston are extendable responsive to a pressure differential between an annulus pressure of a drilling fluid in an annulus between the drill string and the side of the borehole, and a standpipe pressure of a drilling fluid within the drill string.

In another aspect, the disclosure is directed to a method drilling a borehole. The method includes (a) deploying a housing into the borehole, (b) rotating a drill bit supported at a distal end of the housing to break up and generally disintegrate an adjacent geological formation, (c) extending at least one pad piston laterally from the housing to engage a side of the borehole and thereby urge the housing in and the drill bit in an opposite lateral steering, and (d) extending at least one shaft piston laterally with respect to the housing toward an articulating shaft extending at least partially within the housing to thereby pivot the articulating shaft with respect to the housing to further urge the distal end of the articulating shaft and the drill bit in the steering direction.

In some embodiments, the method further includes steering the drill bit through a build section of the borehole by extending both the at least one pad piston and the at least one shaft drilling, and steering the drill bit through an axial section of the borehole by extending only the at least one pad piston and maintaining the at least one shaft piston in a retracted position. In some embodiments, the method further includes extending only the at least one shaft piston and maintaining the at least one pad piston in a retracted position. In some embodiments, the method further includes extending only the at least one shaft piston while maintaining the at least one pad piston in a retracted position.

In some embodiments, the method further includes steering the drill bit through a first portion of the wellbore by extending either only the at least one shaft piston or the at least one pad piston while maintaining the other of the at least one shaft piston and the at least one pad piston in a retracted position, and steering the drill bit through a second portion of the borehole by extending both the at least one pad piston and the at least one shaft piston. The second portion of the wellbore may include a kick-off-point or may exhibit a relatively high dogleg severity compared to the first portion of the wellbore.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A rotary steerable system, comprising:

a housing defining a longitudinal axis, the housing rotatable about the longitudinal axis;

an articulating shaft extending at least partially through the housing, the articulating shaft pivotable between a neutral position generally aligned with the longitudinal axis and an offset position obliquely arranged with respect to the longitudinal axis;

a drill bit supported at a distal end of the articulating shaft;

at least one pad piston extendable laterally from the housing toward an exterior side of the housing to thereby urge the housing in an opposite lateral direction and the drill bit in a lateral steering direction;

at least one shaft piston extendable laterally with respect to the housing toward the articulating shaft to thereby pivot the articulating shaft within the housing to further urge the distal end of the articulating shaft in the steering direction; and a controller operably coupled to the at least one pad piston and the at least one shaft piston to extend the pistons to maintain a bias of the drill bit in the lateral steering direction as the housing rotates about the longitudinal axis.

2. The rotary steerable system according to claim 1, wherein the at least one pad piston and the at least one shaft piston are disposed on opposite lateral sides of the housing and extend in the same direction to urge the distal end of the articulating shaft in the steering direction.

3. The rotary steerable system according to claim 1, further comprising a lower stabilizer disposed below the at least one pad piston and wherein the at least one pad piston and the at least one shaft piston are disposed on the same lateral side of the housing and extend in opposite directions to urge the distal end of the articulating shaft in the steering direction.

4. The rotary steerable system according to claim 1, wherein the controller comprises a valve operable to direct a portion of drilling fluid from an interior flow channel of the housing to the at least one pad piston and the at least one shaft piston.

5. The rotary steerable system according to claim 4, wherein a biasing flow channel extending from the valve branches to both the at least one pad piston and the at least one shaft piston such that drilling fluid provided through the biasing flow channel may extend both the at least one pad piston and the at least one shaft piston.

6. The rotary steerable system according to claim 5, further comprising a supplemental valve in the biasing flow channel operable to prohibit flow to the at least one shaft piston.

7. The rotary steerable system according to claim 4, wherein a biasing flow channel extends from the valve to a first pressure surface of the at least one shaft piston, and wherein a vent shaft extends from an exterior of the housing to a second pressure surface of the at least one shaft piston such that annulus pressure may be applied to the second pressure surface.

8. The rotary steerable system according to claim 7, further comprising a seal member for fluidly isolating the second pressure surface from the interior flow channel of the housing.

9. The rotary steerable system according to claim 8, wherein the seal member comprises a bellows seal defined between the housing and the articulating shaft, and wherein the bellows seal is flexible to accommodate articulation of the articulating shaft within the housing.

10. The rotary steerable system according to claim 1, further comprising at least one external steering pad operatively associated with the at least one pad piston, and wherein the at least one external steering pad is pivotally coupled to the housing to pivot outward when the at least one pad piston is extended.

11. The rotary steerable system according to claim 4, wherein the at least one pad piston comprises at least three pad pistons radially spaced about the housing, wherein the at least one shaft piston comprises at least three shaft pistons radially spaced about the housing, and wherein the valve comprises a rotary disc valve selectable among three positions to direct the portion of drilling fluid from the interior flow channel of the housing to a selected one of the at least three pad pistons and a selected one of the at least three shaft pistons depending on a rotational orientation of the housing.

12. A steerable drilling system, comprising:

a drill string extending from a surface location into a borehole, the drill string operable to rotate about a longitudinal axis of the drill string;

a housing supported within the drill string, the housing rotatable about the longitudinal axis along with the drill string;

an articulating shaft extending at least partially through the housing, the articulating shaft pivotable between a neutral position generally aligned with the longitudinal axis and an offset position obliquely arranged with respect to the longitudinal axis;

a drill bit supported at a distal end of the articulating shaft;

at least one pad piston extendable laterally from the housing to engage a side of the borehole and thereby urge the housing in an opposite lateral direction and the drill bit in a lateral steering direction;

at least one shaft piston extendable laterally with respect to the housing toward the articulating shaft to thereby pivot the articulating shaft within the housing to further urge the distal end of the articulating shaft and the drill bit in the steering direction; and a controller operably coupled to the at least one pad piston and the at least one shaft piston to extend the pistons to maintain a bias of the drill bit in the lateral steering direction as the housing rotates about the longitudinal axis.

13. The steerable drilling system according to claim 12, further comprising a flexible collar coupled within the drill string between the housing and a drill pipe section of the drill string, the flexible collar exhibiting a lower bending stiffness than the drill pipe section.

14. The steerable drilling system according to claim 13, further comprising a stabilizer coupled in the drill string between the drill pipe section and the flexible collar.

15. The steerable drilling system according to claim 13, further comprising a lower stabilizer extending from the housing below the at least one pad piston.

16. The steerable drilling system according to claim 15, further comprising an actuator operably coupled to the lower stabilizer, the actuator selectively operable to retract the lower stabilizer laterally with respect to the housing.

17. The steerable drilling system according to claim 12, wherein the at least one pad piston and the at least one shaft piston are extendable responsive to a pressure differential between an annulus pressure of a drilling fluid in an annulus between the drill string and the side of the borehole, and a standpipe pressure of a drilling fluid within the drill string.

18. A method of drilling a borehole, the method comprising:

deploying a housing into the borehole;

rotating the housing about a longitudinal axis defined by the housing within the borehole;

rotating a drill bit supported at a distal end of the housing to break up and generally disintegrate an adjacent geological formation;

extending at least one pad piston laterally from the housing to engage a side of the borehole and thereby urge the housing in and the drill bit in an opposite lateral steering direction;

extending at least one shaft piston laterally with respect to the housing toward an articulating shaft extending at least partially within the housing to thereby pivot the articulating shaft with respect to the housing to urge the distal end of the articulating shaft and the drill bit in the steering direction; and controlling the at least one pad piston and the at least one shaft piston to extend the pistons to maintain a bias of the drill bit in the lateral steering direction as the housing rotates about the longitudinal axis.

19. The method according to claim 18, further comprising steering the drill bit through a first portion of the wellbore by extending either only the at least one shaft piston or the at least one pad piston while maintaining the other of the at least one shaft piston and the at least one pad piston in a retracted position, and steering the drill bit through a second portion of the borehole by extending both the at least one pad piston and the at least one shaft piston.

20. The method according to claim 19, wherein the second portion of the wellbore includes a kick-off-point or exhibits a relatively high dogleg severity compared to the first portion of the wellbore.

* * * * *